US005180073A

United States Patent [19]

Fay et al.

[11] Patent Number: 5,180,073

[45] Date of Patent: Jan. 19, 1993

[54] PERMEABLE CAP FOR FLASK

[75] Inventors: John E. Fay; Michael T. Faulkner, both of Leominster, Mass.

[73] Assignee: Biomedical Polymers, Inc., Leominster, Mass.

[21] Appl. No.: 703,473

[22] Filed: May 17, 1991

[51] Int. Cl.[5] ..... B65D 53/00

[52] U.S. Cl. ..... 215/261; 215/307; 215/320; 220/732

[58] Field of Search ..... 215/261, 307, 320, DIG. 3, 215/DIG. 4, 354, 355; 220/374, 367, 732, 306, 307

[56] References Cited

U.S. PATENT DOCUMENTS 4,057,160 11/1977 Victor et al. ..... 215/320 X
4,257,526 3/1981 Weits et al. ..... 215/320 X
4,637,520 1/1987 Alvi ..... 215/354 X
4,756,437 7/1988 Rossi-Mossuti ..... 215/316 X
4,785,952 11/1988 Obadia ..... 215/329

FOREIGN PATENT DOCUMENTS 2605694 8/1977 Fed. Rep. of Germany ..... 215/261

*Primary Examiner*—Stephen Marcus
*Assistant Examiner*—Paul A. Schwarz
*Attorney, Agent, or Firm*—Iandioro & Dingman

[57] ABSTRACT

A cap for a flask includes a top portion; an inner collar extending downwardly from the top portion for insertion into the mouth of the flask; an outer collar spaced from the inner collar and extending downwardly from the top portion for covering the lip of the flask; detent means on the inner surface of the outer collar extending inwardly to positively engage the lip of the flask and sealingly engage the cap with the mouth of the flask; and a permeable section in the top portion within said inner collar for enabling exchange of gases in the flask.

8 Claims, 1 Drawing Sheet

PERMEABLE CAP FOR FLASK

FIELD OF INVENTION

This invention relates to an improved cap for a flask or bottle, and more particularly to such a cap which seals the flask yet allows breathing.

BACKGROUND OF INVENTION

Glass bottles or flasks are used in a variety of applications. For example, Erlenmeyer flasks are used in laboratory environments for growing or cultivating a wide range of things including orchids, recombinant DNA, tissue cultures and general laboratory use. In many applications it is necessary to stopper these bottles and flasks in order to establish a good fluid seal against leakage. Rubber stoppers and corks are historically used, in part because they easily adjust to the wide I.D. and O.D. tolerances of glass receptacles. But conventional corks and stoppers are not wholly suitable because they become contaminated and cannot be easily sterilized. Often laboratory personnel simply use plastic film, tin foil or the like with a rubber band to cover the mouth of the bottle or flask. These are not truly dependable and while they do keep out contaminants to some degree, they do not function well to prevent spillage if the flask is tilted or falls over. Frequently a piece of fabric is stuffed into the opening in the bottle to act as a plug or stopper. A fabric plug suffers from the same shortcomings as enumerated above, although it does address another problem: it allows the bottle to breathe. That is, air and oxygen can be exchanged through the fabric plug and gas pressure buildup can be released through the fabric too. These are important considerations when aerobic activity is occurring in the flask. A further problem is that most of the stoppers or plugs do not protect the mouth of the bottle against damage: if the flask should fall over, the lip of the flask hits the surface and cracking or shattering is likely. One attempt to provide an improved cover uses a very soft plastic which is difficult to install and remove and is extremely expensive. In addition it uses a sponge-like insert in the cover to permit a measure of breathing, but the spongy material is susceptible to contamination and is difficult to sterilize.

SUMMARY OF INVENTION

It is therefore an object of this invention to provide an improved cap for a bottle or flask which easily adjusts to the range of tolerance encountered in glass bottles or flasks.

It is a further object of this invention to provide such an improved cap which positively engages the flask opening and forms a tight fluid seal.

It is a further object of this invention to provide such an improved cap which protects the mouth of the flask from cracking and damage.

It is a further object of this invention to provide such an improved cap which has a permeable portion to permit the flask to breathe.

It is a further object of this invention to provide such an improved cap which is easy to install and remove and easy to sterilize.

It is a further object of this invention to provide such an improved cap in which the permeable portion is integral with the remainder of the cap.

It is a further object of this invention to provide such an improved cap which permits passage of smaller molecules like oxygen and other respiratory gases but blocks large molecules such as water.

The invention results form the realization that a truly functional, effective cap for a flask or bottle can be achieved by having an inner and outer collar, with the inner collar sized to fit snugly in the mouth of a flask and the outer collar containing a detent for engaging the lip of the bottle or flask to sealingly engage the cap with the flask, the additional realization that the outer collar can be flared to act as a cushion for the lip and neck of the flask, and the further realization that the cap can be made with an integral permeable portion that enables exchange of gases but blocks passage of large molecules.

This invention includes a cap for a flask including a top portion and an inner collar extending downwardly from the top portion for insertion into the mouth of the flask. There is an outer collar spaced from the inner collar and extending downwardly from the top portion for covering the lip of the flask. There are detent means on the inner surface of the outer collar extending inwardly to positively engage the lip of the flask and sealingly engage the cap with the mouth of the flask. A permeable section within the inner collar for enabling exchange of gases in the flask.

In a preferred embodiment, the inner collar may be tapered inwardly for ensuring positive fit with the flask and the outer collar may be flared outwardly to define an enlarged space between the outer collar and the flask to provide a cushion about the lip of the flask. The detent may include a peripheral bead or a plurality of discrete salient elements. The permeable section may be a polyolefin or a copolymer of polypropylene of $0.010 \pm 0.002$ inch or less in thickness. The collars, the top and the permeable section may all be made of the same material. The material may be polyolefin such as a copolymer of polypropylene.

DISCLOSURE OF PREFERRED EMBODIMENT

Other objects, features and advantages will occur to those skilled in the art from the following description of a preferred embodiment and the accompanying drawings, in which.

The invention may be accomplished in a cap for a flask which has a top portion, an inner collar which extends downwardly from the top portion and sits inside of the mouth of the flask, and an outer collar which is spaced from the inner collar and extends downwardly from the top portion to cover the lip of the flask, and some of the neck of the flask or bottle. There are detent means on the inner surface of the outer collar, such as a bead or a plurality of discrete elements, which extend inwardly to positively engage the lip of the flask and sealingly engage the cap with the mouth of the flask. There is a permeable section in the top portion within the inner collar for enabling air exchange between the flask and its environment.

The inner collar can be slightly tapered inwardly to ensure a positive fit with the mouth of the flask regardless of fairly wide variations in the tolerances of the flask opening, as is common in Erlenmeyer flasks and other flasks and bottles. The outer collar is generally resilient and is flared outwardly to define an enlarged space between the outer collar and the flask to provide a cushion about the lip of the flask. If the flask is tilted or knocked over and it lands on its upper end, the outer collar acts as a cushion to protect the lip of the flask from cracking or damage. The permeable section is typically a polyolefin such as copolymers of polypropylene, which is approximately 0.010 inch thick or less, typically 0.008 inch, so that it is permeable to gases and yet impermeable to heavier molecules such as water. This allows the cap to breathe so that aerobic activity can take place in the flask. It also allows excess pressure and waste gases to be evacuated through the permeable section. The collars, the top, and the permeable section typically are all made of the same material for ease of manufacture and integrity. Although in the following illustrative example of an embodiment the cap is shown threadless, this is not a necessary limitation of the invention. For example, the cap may be provided with threads to engage a threaded bottle or flask such an Erlenmeyer flask.

Figure 1:
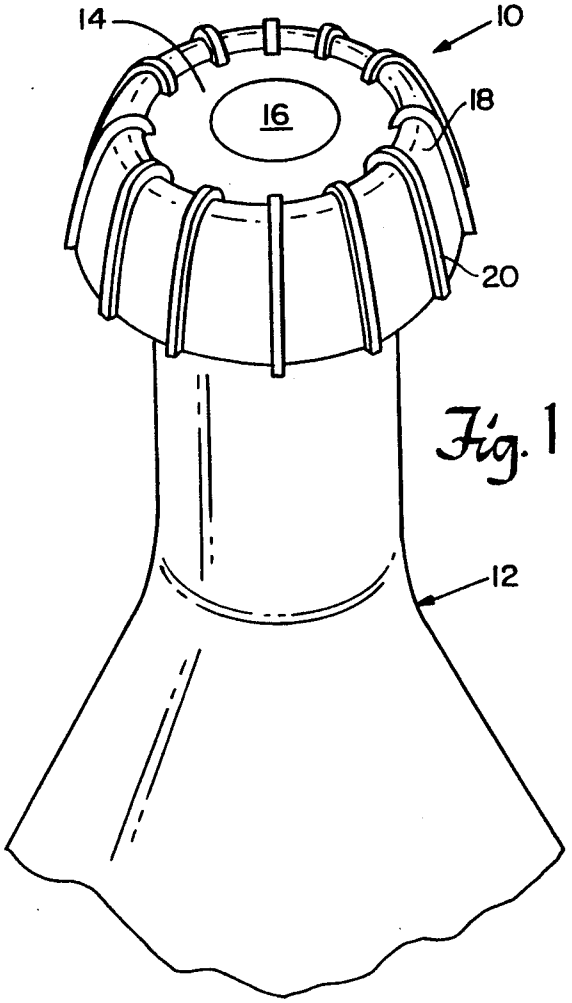
FIG. 1 is a perspective view of a cap according to this invention installed on a common laboratory flask.

There is shown in FIG. 1 a cap 10 according to this invention installed on a bottle such as a common flask 12 of the Erlenmeyer type. Cap 10 includes a top portion 14 including a permeable section 16 and an outer collar 18 having raised ribs 20.

Figure 2:
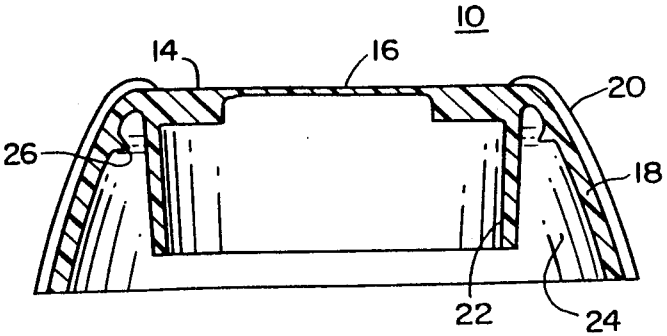
FIG. 2 is a side elevational view in cross-section of the cap of FIG. 1.
Figure 3:
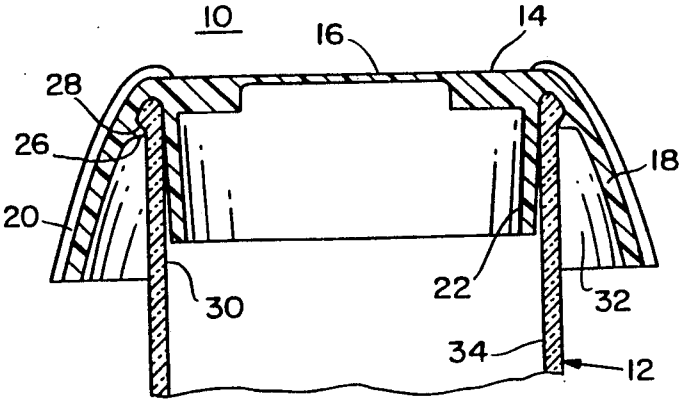
FIG. 3 is a bottom plan view of the cap of FIG. 2 showing an alternative embodiment using discrete detents.

There is also an inner collar 22, FIG. 2. Both the outer collar 18 and the inner collar 22 extend downwardly from top portion 14. Inner collar 22 may be tapered gently inwardly in order to accommodate a wide deviation in the diameter of the flask. Outer collar 18 is tapered and flares outwardly to create an enlarged space 24 between the two collars. Cap 10 may be made entirely of the same material, typically a polyolefin, which may be a copolymer such as polypropylene. The permeable section 16 is integrally formed with top portion and collars 18 and 22, but it is molded to have a thickness of 0.010±0.002 inch so that it acts as a permeable membrane at the molecular level. At this thickness, polyolefins will pass gases such as respiratory gases like oxygen and carbon dioxide, but block the passage of fluids such as water, making cap 10 an ideal closure for aerobic applications where oxygen exchange is required and gas release is a necessity while passage of water or moisture must be blocked. The permeable section 16 is easily punctured by a needle for extraction or addition of substances to the materials contained in the flask. Outer collar 18 includes a peripheral or annular bead 26 which acts to interlock with the lip on flask 12 to create a positive sealing engagement between flask 12 and cap 10 as shown in FIG. 3. There detent 26 grips the underside of lip 28 to positively engage lip 28 with the top portion 14 of cap 10. At the same time the inner collar 22 snugly engages the mouth 30 of flask 12. The flared construction of outer collar 18 creates a substantial space 32 between collar 18 and neck 34 of flask 12. This space 32 provides a cushioning effect so that should the flask 12 with cap 10 in place be tilted or knocked over, its lip and the upper portion of its neck are cushioned when the cap strikes the surface and absorbs the shock. The resilience of the polyolefin material of cap 10 further enhances the cushioning effect.

Figure 4:
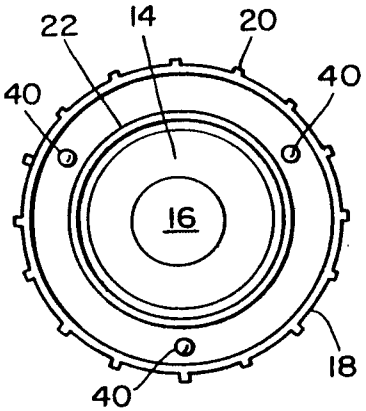
FIG. 4 is a side elevational cross-sectional view of the cap of FIG. 2 installed on a flask such as that shown in FIG. 1.

Although cap 10 has thus far been shown as having a continuous peripheral bead such as annular bead 26, FIG. 2, this is not a necessary limitation of the invention. For example, as shown in FIG. 4, the detent means could be one or more discrete salient elements 40 which engage at discrete points with lip 28.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A permeable cap for a flask, comprising:

a top portion;

an inner collar extending downwardly from said top portion for insertion into the mouth of a flask, the inner collar being tapered inwardly to positively engage the flask;

an outer collar spaced from said inner collar extending downwardly from said top portion and being flared generally conically outwardly beyond said top portion to define an enlarged space between said outer collar and the flask below said top portion, said outer collar both covering the lip of the flask and providing a prominent buffer to protect said top portion of the cap and the lip of the flask;

detent means on the inner surface of said outer collar extending inwardly to positively engage the lip of the flask and sealingly engage the cap with the mouth of the flask, said detent means being disposed above said enlarged space between said outer collar and the flask; and a permeable section in said top portion within said inner collar for enabling exchange of gases in the flask.

2. The cap of claim 1 in which said detent means includes a peripheral bead.

3. The cap of claim 1 in which said detent means includes a plurality of discrete salient elements.

4. The cap of claim 1 in which said permeable section is a polyolefin of 0.010±0.002 inch or less in thickness.

5. The cap of claim 1 in which said cap including said collars, said top and said permeable section are all made of the same material.

6. The cap of claim 5 in which said material is a polyolefin.

7. The cap of claim 6 in which said material is a copolymer.

8. The cap of claim 7 in which said material is a polypropylene.

* * * * *